United States Patent [19]

Dodds

[11] 4,296,359

[45] Oct. 20, 1981

[54] TELEVISION DISPLAY ERROR CORRECTION

[75] Inventor: Dennis L. Dodds, Indianapolis, Ind.

[73] Assignee: RCA Corporation, New York, N.Y.

[21] Appl. No.: 88,657

[22] Filed: Oct. 29, 1979

[51] Int. Cl.[3] ..... H01J 29/56

[52] U.S. Cl. ..... 315/370; 335/213; 313/430

[58] Field of Search ..... 315/370, 13 C, 8; 358/10; 335/213; 313/429, 430

[56] References Cited

U.S. PATENT DOCUMENTS

| | | | |
|---|---|---|---|
| 2,898,509 | 8/1959 | Clay et al. | 315/8 |
| 2,907,914 | 10/1959 | Brownell | 315/8 |
| 2,962,621 | 11/1960 | Fernald | 315/8 |
| 4,145,677 | 3/1979 | Maruyama et al. | 335/212 |

*Primary Examiner*—Theodore M. Blum

*Attorney, Agent, or Firm*—Eugene M. Whitacre; Paul J. Rasmussen; Scott J. Stevens

[57] ABSTRACT

To correct the effects of an in-line electron gun mount rotation error on a kinescope display screen, initially the horizontal deflection axis of the yoke is aligned with the actual axis of alignment of the electron guns. The resultant rotated raster is then rotated into alignment with the kinescope major and minor axes through the use of a magnetic field disposed orthogonal to the yoke deflection fields. The magnitude of the field is selected to effect the desired magnitude of raster rotation, while the polarity of the field is selected to effect the desired direction of raster rotation. In one embodiment, a coil of wire placed to abut the kinescope funnel in front of the deflection yoke and powered by a variable DC voltage source provides the desired magnetic field. In another embodiment, a permanent magnet ring takes the place of the coil -DC source combination.

5 Claims, 6 Drawing Figures

TELEVISION DISPLAY ERROR CORRECTION

This invention relates to a method and apparatus for correcting the effects on a display raster of an electron gun mount rotation error in a color kinescope of the in-line gun type.

Self-converging color television display systems eliminate the need for electron beam dynamic convergence apparatus by utilizing the beam deflection fields to maintain substantial convergence of the beams at all points on the viewing screen of the picture tube. This is accomplished generally by designing the horizontal and vertical deflection coils of the electromagnetic deflection yoke to produce a pincushion-shaped horizontal deflection field and a barrel-shaped vertical deflection field. Specifically, the nonuniform or $H_2$ components of the magnetic fields along the longitudinal central axis of the deflection yoke are selected for optimizing the beam convergence pattern along the deflection axes and in the corners of the raster displayed on the viewing screen of the kinescope. Such an arrangement is disclosed in U.S. Pat. No. 3,800,176—Gross, et al.

Manufacturing tolerance in the fabrication and assembly of the deflection yoke and picture tube components result in a spread and variation of beam convergence errors from one display unit to another. Techniques are known by which these convergence errors can be reduced. For example, U.S. Pat. No. 3,789,258—Barbin, discloses that the deflection yoke may be moved relative to the picture tube to achieve an improved alignment of the deflection fields relative to the beams, after which the deflection yoke is fixedly retained in the optimum position, for minimizing the residual convergence errors of a given yoke-tube combination. Prior to the aforementioned operation, it is known that the components of the deflection yoke itself can be adjusted relative to each other to ensure that each deflection yoke is as close to the design goal as possible. Among the techniques used are rotating the vertical and horizontal coils relative to each other about the deflection yoke longitudinal axis to ensure orthogonality of the deflection axis and moving the vertical and horizontal deflection coils slightly relative to each other or to the deflection yoke ferrite core in directions transverse to the deflection yoke axis to optimize convergence conditions. These latter motions generally control the width, height and tilt of the rasters produced by the outer two of the three in-line beams of the picture tube relative to each other. The tilt condition is observed as trapezoidal-shaped rasters or crossover of horizontal lines of the rasters rather than a parallel and superimposed horizontal line condition. The deflection yoke component movements generally produce display pattern convergence changes similar to the movement of the entire deflection yoke relative to the picture tube. It can be seen that adjustment of the deflection yoke components followed by adjustment of the entire deflection yoke assembly relative to the picture tube achieves the best possible convergence condition.

The previously described adjustments are made to correct deflection yoke generated convergence errors. During adjustment of the deflection yokes, however, error that is not attributable to the deflection yoke or yoke components arises when the in-line electron guns are misaligned with respect to the kinescope major axis. This misalignment causes vertical misconvergence of horizontal lines along the major axis. The misconvergence also extends into the corners of the raster, making it difficult to measure the actual deflection yoke error.

The present invention provides an apparatus and method for eliminating the distortion caused by the gun mount rotation error. Initially, the beam misconvergence caused by the rotation error can be corrected by rotating the deflection yoke until the deflection axis becomes aligned with the plane of the electron guns. This, however, causes the raster display on the kine to appear alightly rotated, which creates difficulties in the adjustment of the deflection yoke during yoke construction, and presents an unsatisfactory display when used in production receivers. A solution to the raster rotation is provided by applying an electromagnetic field orthogonal to the deflection axes (commonly called a Z-field) between the deflection yoke and the kine screen, adjacent to the yoke. During deflection yoke adjustment on test kinescopes, this field can be applied by use of a wire coil positioned around the funnel of the kine and driven by a variable DC power supply. In production receivers, premagnetized or pulse magnetized permanent magnet rings can be used. The magnitude and direction of this Z-field can be selected to cause the raster to rotate to the desired position with the deflection axes aligned with the major and minor axes on the kine face.

Figure 1:
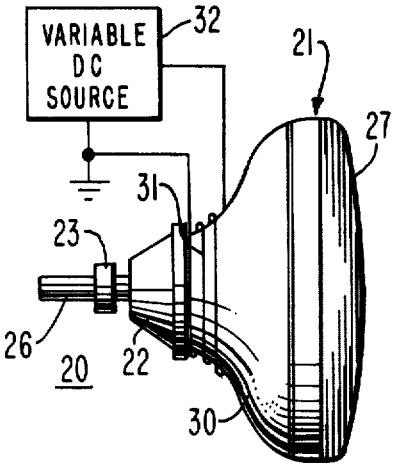
FIG. 1 is a side elevational view of a color television picture tube assembly incorporating correction apparatus in accordance with one embodiment of the present invention.
Figure 2:
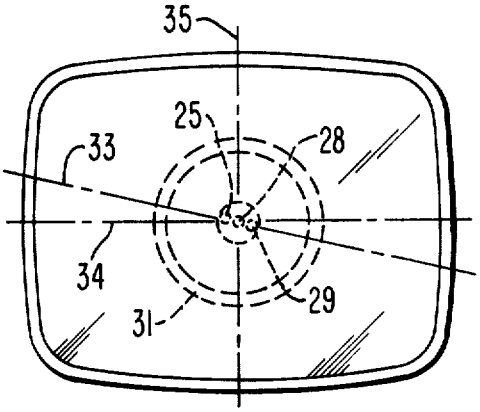
FIG. 2 is a front elevational view of the picture tube assembly shown in FIG. 1, with the tube's electron guns, subject to an error shown in phantom.

Referring to FIGS. 1 and 2, there is shown a color television picture tube arrangement 20 comprising a kinescope 21, a deflection yoke 22 and magnetic neck components 23 mounted on the kinescope neck 26. A wire coil 31 is mounted in front of the yoke 22 abutting the kinescope funnel 30, with the turns of coil 31 coaxially disposed with respect to neck 26. The coil 31 is electrically connected to a variable DC voltage source 32. The kinescope 21 is a conventional color picture tube with blue, green and red electron guns 25, 28 and 29, respectively, located at the end of the kinescope neck 26 opposite the display screen 27. The electron guns 25, 28 and 29 are arranged in an in-line configuration. The kinescope in FIG. 1 is illustratively used in deflection yoke test equipment to optimize convergence of the production yokes. The deflection yoke 22 to be adjusted is mounted on the neck 26 of the kinescope 21. The yoke 22 is located at the forward portion of the kinescope neck 26 where the neck expands to form the funnel 30 of the kinescope 21. The neck components 23 are disposed about the neck 26 behind the deflection yoke 22. The neck components are typically rings of multipole magnets, such as described in U.S. Pat. No. 3,725,831—Barbin, that aid in the convergence of the electron beams on the kinescope display surface 27.

It is often desirable for speed and efficiency to adjust the deflection yoke for best convergence on a deflection yoke coil adjustment machine (not shown). The yoke coil adjustment machine (CAM) comprises means for supporting and energizing the kinescope and yoke deflection coils to produce a display on the kine screen. The CAM also comprises moveable gears or arms which can interact with the deflection coils of the yoke to move the coils with respect to each other or with the neck components to achieve the least amount of convergence error.

Figure 3:
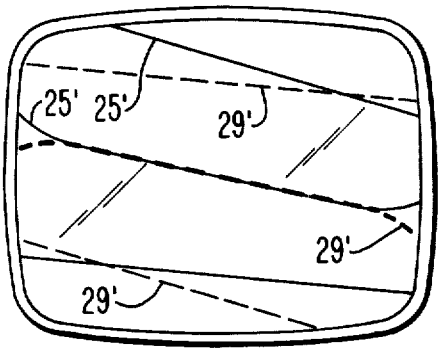
FIG. 3 is a front elevational view of the color television picture tube of FIG. 2, the uncorrected effects on a display of said gun mount rotation error.

FIG. 2 illustrates the in-line electron guns having a gun mount rotation error resulting in the misalignment of the gun axis 33 with the kinescope horizontal or major axis 34. To aid in illustration, the magnitude of the rotation error is exaggerated in FIG. 2 relative to that likely to be encountered in practice. Coil 31 is shown in phantom surrounding the deflection center axis. When the horizontal and vertical deflection axes of the deflection yoke 22 are aligned (in normal fashion) with the major and minor (vertical) axes 34, 35 of the kinescope display screen, and a condition of gun mount rotation error exists as shown in FIG. 2, a pattern of electron beam misconvergence, such as that shown in FIG. 3, may be formed on the kine display screen. The representative picture shown in FIG. 3 illustrates only selected lines of the two outside beam rasters; i.e., the blue and the red. The green raster will fall between the red and the blue on the screen. The lines of the blue and red rasters are designated 25' and 29', respectively. It can be seen in FIG. 3 that the upper raster lines cross near the right side of the screen, while the lower raster lines cross near the left side of the screen. The center raster lines also diverge near the edges of the screen. These asymmetry of these misconvergence errors are attributable to the gun mount rotation error, and not to the deflection yoke, making it difficult to adjust the deflection yoke for least convergence error.

Figure 4:
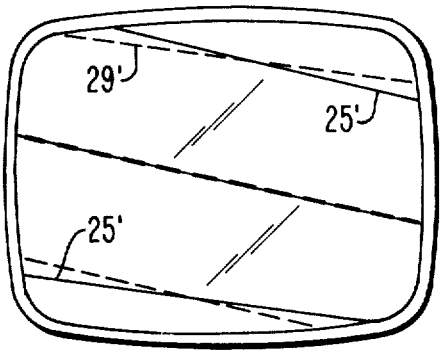
FIG. 4 is a front elevational view of the color television picture tube of FIG. 2, showing the effects on a display of an initial step in an error-correcting method carried out in accordance with the principles of the present invention.

As an initial step in an error correcting method in accordance with the principles of the present invention, the deflection yoke 22 is rotated to align the horizontal deflection axis with the in-line gun axis 33. Although this eliminates the asymmetry of the convergence errors of FIG. 3, the resulting display on the kine display surface 27 will be rotated as seen in FIG. 4. During adjustment of the deflection yoke with the CAM, it is a common practice to align the deflection yoke vertical deflection coils initially to produce a single vertical raster stripe on the kine face. If the deflection yoke is aligned with the gun axis as shown in FIG. 4, it is not possible to align the vertical yoke coils by using a vertical stripe, necessitating another method which is more difficult and time consuming.

The rasters on the display screen, however, can now be rotated to align the horizontal raster lines with the kinescope major axis through the use of coil 31 and variable DC source 32. Current flowing through circularlywound coil 31 creates a magnetic field orthogonal to the horizontal and vertical yoke deflection fields. This magnetic field, called a "Z" field because of its orthogonal orientation with the X and Y horizontal and vertical deflection fields, causes the electrons in the electron beams to experience a force in a direction at right angles to their direction of motion. The sense of this right-angled force is determind by the direction of current flowing in the coil 31, which is determined by the polarity of the DC source 32. For example, an electron deflected from the center to the edge of the screen in a horizontal direction will experience a force from the coil-induced magnetic field that will cause it to move either up or down, depending on the direction of current flow in the coil 31. Electrons deflected vertically will experience a shift to the right or left, while electrons deflected at other angles will experience a shift that is a vector sum of horizontal and vertical components. The magnitude of the shift varies directly with distance of the electron landing position from the kinescope's longitudinal axis. The net effect of the "Z" field developed by coil 31 is a rotation of the displayed raster, with the magnitude of rotation determined by the magnitude of the current in coil 31, and the rotation direction determined by the polarity of the current in coil 31.

Figure 5:
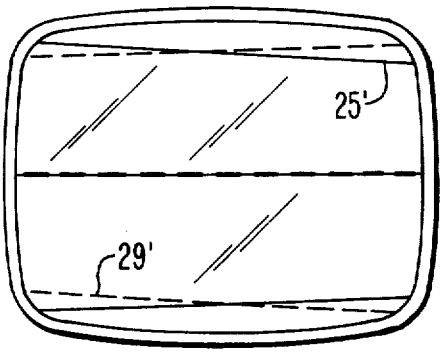
FIG. 5 is a front elevational view of the color television picture tube of FIG. 2, showing the effects on a display of completion of an error-correcting method carried out in accordance with the principles of the present invention.

The rotated raster lines 25' and 29' of FIG. 4 can be rotated into alignment with the kinescope major axis by first selecting the polarity of source 32 to effect a raster rotation in the desired direction (counterclockwise in FIG. 4) and then adjusting source 32 to provide sufficient current flow through coil 31 to bring the rasters into alignment with the kinescope major axis, as shown in FIG. 5. FIG. 5 illustrates the red and blue rasters with the effects of the electron gun mount rotation error eliminated. The remaining misconvergence errors, illustrated in FIG. 5 as separation of lines 25' and 29' in the corners of the screen, can now be treated in conventional ways, for example, through the use of neck components 23.

Satisfactory results have been found using an air core coil having approximately 115 turns with a width of 0.20 inches and an inside diameter of 6 inches. A well-regulated power supply adjustable from 0 to 5 volts, with a maximum current of 0.250 amps, provides sufficient range to correct the effects of gun mount rotation errors that occur. Modifications in coil dimensions may of course be made, with the possibility that modification will also be required in the DC power supply. It is understood that these and other modifications fall within the scope of this invention.

Figure 6:
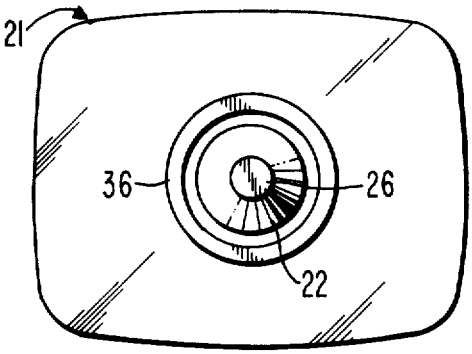
FIG. 6 is a rear elevational view of a color television picture tube assembly illustrating a further embodiment of the present invention in place.

The previous description has been concerned with correcting the display effects of a gun mount rotation error present in a test kinescope used in yoke coil adjustment machines to insure that the deflection yokes being adjusted cause proper convergence of the electron beams. The described gun mount rotation error, however, can also occur in production kinescopes employed in the assembly of color television receivers, resulting in raster convergence errors in the receiver's display even with properly adjusted deflection yokes. While correction apparatus of the form shown in FIG. 1 may be employed so that the above-described correction method can be practiced in the receiver, there may be undesired inconvenience and expense associated with the provision of the adjustable DC source and the coupling therefrom to the "Z" field producing coil. FIG. 6 illustrates an alternative form of correction apparatus, particularly attractive for receiver use, in which a permanent magnet ring is employed for the "Z" field production, whereby the DC source and coupling requirements are eliminated.

Referring to FIG. 6, there is shown a permanent magnet ring 36 that is positioned about the kinescope funnel in a position similar to that occupied by coil 31 in FIG. 1. The ring 36 is large enough to fit over the deflection yoke 22 to aid in installation. During adjustment of the receiver's yoke/kinescope combination, horizontal deflection axis of the yoke 22 is aligned with the actual axis of alignment of the electron guns, producing blue and red raster lines as shown in FIG. 4. A permanent magnet ring 36 is then placed around the kinescope funnel 30 in the illustrated position. The magnetic field induced by ring 36 effects raster rotation in the same manner as coil 31. The ring 36 is magnetized to have a north pole defined by one face of the ring, with the south pole defined by the other face. The direction of the induced magnetic field will be determined by the orientation of the ring on the kinescope; i.e., whether the north pole face is facing the front or back of the kinescope.

In order to accurately align the raster lines with the kine major axis, it is necessary that rings of different magnetic strengths be available to correct different amounts of mount rotation error. This can be done by providing a number of different strength rings, each magnetized to correct a particular amount of error. The deflection yoke adjusting operator, once the magnitude and direction of the error is determined (e.g., by measuring the misalignment on the kine screen), can then select a ring of appropriate strength, and place it on the kine with the proper front-to-back pole orientation, securing it in place with tape or other mounting means. Alternately, a ferrite ring may be pulse-magnetized while the ring is in place by a magnetizing source which may be adjusted similar to source 32.

What is claimed is:

1. A method for correcting the effects on a display raster of an electron gun mount rotation error in a color kinescope having in-line electron guns and a display screen, comprising the steps of:

aligning the horizontal deflection axis of a deflection yoke mounted on said kinescope with the axis of alignment of said kinescope electron guns; and generating, at a location adjacent to the exit end of said deflection yoke, an electron-influencing magnetic field extending in a direction orthogonal to the directions of the horizontal and vertical deflection fields produced by said deflection yoke and of a magnitude and polarity chosen to effect alignment of the horizontal axis of said display raster with the horizontal axis of the kinescope display screen.

2. Apparatus comprising the combination of:

a color kinescope having a display screen, and a plurality of in-line electron gun structures aligned along a first axis, said first axis being rotationally misaligned with the horizontal axis of said kinescope display screen;

a deflection yoke, having respective horizontal and vertical deflection axes, mounted on said kinecope in such manner that said horizontal deflection axis is aligned with said first axis; and means mounted on said kinescope in a position adjacent the exit end of said yoke, for generating an electron-influencing magnetic field, said field having a direction orthogonal to said horizontal and vertical deflection axes and influencing the electrons from said electron gun structures in a manner effecting a raster rotation of such a magnitude and direction as to align the horizontal axis of the raster developed by said yoke with the horizontal axis of said display screen.

3. The apparatus defined in claim 2, wherein the means for generating an electron-influencing magnetic field comprises a field-inducing coil electrically connected to a source of DC voltage, the voltage of said voltage source being variable in magnitude and polarity.

4. The apparatus defined in claim 2, wherein the means for generating an electron-influencing magnetic field comprises a permanent magnet ring disposed about the neck of said kinescope.

5. The apparatus defined in claim 2, wherein the means for generating an electron-influencing magnetic field comprises means for varying the magnitude and direction of said field.

* * * * *